US005634979A

United States Patent [19]

Carlson et al.

[11] Patent Number: 5,634,979

[45] Date of Patent: Jun. 3, 1997

[54] COMPOSITION AND METHOD FOR DEGREASING METAL SURFACES

[75] Inventors: Lawrence R. Carlson, Waterford; Philip M. Johnson, Southfield; Dennis A. Kent, Rochester Hills, all of Mich.

[73] Assignee: Henkel Corporation, Plymouth Meeting, Pa.

[21] Appl. No.: 362,619

[22] Filed: Dec. 22, 1994

[51] Int. Cl.[6] ..... C23G 1/24; C11D 1/68; C11D 3/24; C11D 3/60

[52] U.S. Cl. ..... 134/3; 134/40; 134/41; 510/245; 510/254; 510/255; 510/258; 510/264; 510/265; 510/269; 510/271; 510/272; 510/422; 510/434; 510/435; 510/436; 510/506

[58] Field of Search ..... 252/174.22, 174.21, 252/156, 544, DIG. 1, DIG. 8, 173, DIG. 14, 158, 170, 171; 134/40, 3, 41; 510/245, 254, 255, 258, 264, 265, 269, 271, 272, 422, 434, 435, 436, 506

[56] References Cited

U.S. PATENT DOCUMENTS

| | | | |
|---|---|---|---|
| Re. 31,198 | 4/1983 | Binns | 134/3 |
| Re. 32,661 | 5/1988 | Binns | 252/142 |
| 3,282,843 | 11/1966 | Alburgen | 252/52 |
| 3,607,764 | 9/1971 | Crotty et al. | 252/139 |
| 3,691,081 | 9/1972 | Thompson et al. | 252/89 |
| 3,948,819 | 4/1976 | Wilde | 252/545 |
| 4,129,514 | 12/1978 | Caffarel et al. | 252/89 R |
| 4,137,190 | 1/1979 | Chakvabarti et al. | 252/135 |
| 4,348,294 | 9/1982 | King | 252/142 |
| 4,517,025 | 5/1985 | Plante et al. | 134/38 |
| 4,540,442 | 9/1985 | Smith et al. | 134/2 |
| 4,627,931 | 12/1986 | Malik | 252/153 |
| 4,668,421 | 5/1987 | Dollman | 252/136 |
| 4,851,149 | 7/1989 | Carandang | 252/147 |
| 5,093,031 | 3/1992 | Login et al. | 252/357 |

FOREIGN PATENT DOCUMENTS

| | | |
|---|---|---|
| 0598973 A1 | 11/1992 | European Pat. Off. . |
| 616027A1 | 9/1994 | European Pat. Off. . |
| WO94/12599 | 6/1994 | WIPO . |

*Primary Examiner*—Ardith Hertzog

*Attorney, Agent, or Firm*—Ernest G. Szoke; Wayne C. Jaeschke; Norvell E. Wisdom, Jr.

[57] ABSTRACT

The invention is a cleaning solution for degreasing metal articles which contains at least one chlorine-free nonionic surfactant with an HLB in the range of 6.5 to 9.5; a second chlorine-free nonionic surfactant with an HLB in the range of above 9.5 to about 14; a chlorinated nonionic surfactant, and an alkalinizing agent and optionally also one or more of anionic or amphoteric surfactant; hydrotroping agents; solubilizers; organic builders, and corrosion inhibitors. The preferred composition of the invention can replace a vapor degreasing process for cleaning oil, grease, and waxy-type contaminants from metal articles to the level of cleanliness required in the aerospace industry.

20 Claims, No Drawings

COMPOSITION AND METHOD FOR DEGREASING METAL SURFACES

BACKGROUND OF THE INVENTION

1. Field of the Invention

The invention relates to a process for degreasing metal surfaces, especially aluminum and aluminum alloy metal surfaces. Aqueous compositions and methods of the invention provide satisfactory degreasing of metal surfaces for use in the aerospace industry The compositions and methods of the present invention can be utilized to replace vapor degreasing operations in many metal fabricating operations.

2. Statement of Related Art

Many mechanical operations such as stamping, cutting, welding, grinding, drawing, machining, and polishing are used in the metal working industry to provide shaped metal articles. In metal working operations, lubricants, antibinding agents, machining coolants and the like are normally utilized to prevent binding and sticking of the tools to the metal articles in the various metal working operations. The lubricants, coolants, and antibinding agents and the additives present in these compositions usually leave an oily, greasy, and/or waxy residue on the surface of the metal which has been worked. The residue normally should be removed before the worked articles are given a protective surface finish or incorporated into a finished assembly.

Until the present time, it has been customary to clean oily, greasy, and/or waxy residues from metal articles by a vapor degreasing process. In a vapor degreasing process, the metal articles, at a temperature below the condensing temperature of a solvent for the oily, greasy and/or waxy residues, are suspended in vapors of refluxing solvent. The refluxing solvent condenses on the surface of the metal article, and the liquid solvent dissolves the oily, greasy, and/or waxy residues on the surface of the metal article. The condensing solvent with the high dissolving power for the contaminants to be removed from the surface of the metal article condenses on the surface of the article, dissolves the contaminants, and is returned to the source of the solvent vapor.

Solvents such as methyl ethyl ketone, methylene chloride, 1,1,1-trichloroethane, trichloroethylene, perchloroethylene, and the like are normally used in the vapor degreasing process. Since the oily, greasy, and/or waxy soils removed from the metal articles generally have a boiling point substantially higher than the boiling point of the refluxing solvent, the metal articles are contacted with a condensed solvent containing only relatively small quantities of the contaminants to be dissolved and removed from the metal articles.

Vapor degreasing is technically effective but economically and environmentally disadvantageous. The solvents are expensive, can be environmental pollutants and require costly methods for reclamation and disposal. Special apparatus and processes are required to reclaim the dirty solvent for reuse and to prevent solvent vapors from escaping from the vapor degreasing process. The solvent vapors are often hazardous to human health and some of them are suspected of promoting degradation of the earth's ozone layer. In view of the drawbacks in the use of the vapor degreasing process, many attempts have been made to replace vapor degreasing with aqueous based cleaning compositions. However, to date the aqueous cleaning methods have not been entirely satisfactory, particularly in preparing metallic surfaces of relatively low density, such as those of aluminum and aluminum alloys, for use in the aerospace industry, where the requirements for cleaning are particularly stringent.

DESCRIPTION OF THE INVENTION

Object of the Invention

A major object of the invention is to provide a water-based liquid cleaner that is capable of degreasing normally worked metal articles effectively enough to meet the stringent standards established for aluminum and its alloys in the aerospace industry. Other objects are to provide a more economical process, a faster process and/or one requiring less expensive equipment for operation on a large scale, and to reduce hazards of fire and of damage to the environment from discharge of the used cleaner.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percents, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of electrically neutral constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

The term "aluminum" when used hereinafter this specification, unless the context requires otherwise, is to be understood to include pure aluminum and all the alloys of aluminum that contain at least 45% of aluminum by weight.

SUMMARY OF THE INVENTION

The working metal cleaning compositions of the invention comprise, preferably consist essentially of, or more preferably consist of, water and the following dissolved, stably dispersed, or both dissolved and stably dispersed components:

(A) a component of substantially chlorine free nonionic surfactant with a hydrophilelipophile balance ("HLB") value from about 6.0 to 9.5;

(B) a component of substantially chlorine free nonionic surfactant with an HLB value from above 9.5 to 16;

(C) a component of nonionic surfactant that has a polyoxyalkylene chemical structure, except for being chlorine-capped on one or both ends and optionally including total or partial fluorine substitution for hydrogen in the alkylene units;

(D) a component of organic compounds that are liquid at 25° C. and are selected from the group consisting of (i)

compounds made up of molecules that contain at least two hydroxyl oxygen atoms and otherwise contain only carbon and hydrogen and, optionally, halogen atoms, preferably only carbon and hydrogen atoms; (ii) compounds made up of molecules that contain at least two ether oxygen atoms and otherwise contain only carbon, hydrogen, hydroxyl oxygen, and/or halogen atoms, preferably only carbon and hydrogen atoms and not more than one hydroxyl oxygen atom; and (iii) compounds made up of molecules that include a moiety corresponding to general chemical formula I:

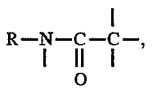

(I)

where R represents a monovalent aliphatic, preferably straight chain, moiety with the chemical formula $-C_nH_{(2n+1-y)}F_y$, wherein n is an integer from 6 to 22, and y is an integer from 0 to (2n+1); and (E) a component of alkalinizing agent; and, optionally, one or more of:

(F) a component of anionic surfactant, including amphoteric surfactants which act effectively as anionic surfactants at the pH of the composition;

(G) a component of hydrotroping agents;

(H) a component of organic corrosion inhibitors; and (J) a component of sequestering agents.

In this description, "stably dispersed" means that the component so described can be dispersed by mixing within 1 hour of its introduction into the liquid phase in which the component in question is described as stably dispersed to produce a liquid mixture which has only one bulk phase detectable with unaided normal human vision and does not spontaneously develop any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed. (The word "bulk" in the preceding sentence means that, to be considered as a bulk phase, a phase must occupy at least one volume of space that is sufficiently large to be visible with unaided normal human vision and is separated from at least one other phase present in the dispersion by a boundary surface that can be observed with unaided normal human vision. Therefore, a change of the composition from clear to hazy or from hazy to clear does not indicate instability of a dispersion within this definition, unless a separate liquid or solid phase develops in the mixture in at least one volume large enough to see independently with unaided normal human vision.) The term "substantially chlorine-free" means containing not more than 1.0%, or, with increasing preference in the order given, not more than 0.7, 0.5. 0.4, 0.3, 0.20, 0.15, 0.13, 0.11, 0.09, 0.07, 0.05, or 0.02% stoichiometric equivalent of chlorine atoms in any chemical form.

Compositional embodiments of the invention include liquid compositions ready for use as such in cleaning (i.e., "working compositions") and concentrates suitable for preparing working compositions by dilution with water. Concentrates may be single package or multiple, usually dual, package in nature. A multiple package type of concentrate is preferred when not all of the ingredients desired in the working composition are sufficiently soluble or stably dispersible at the higher concentrations required for a one package concentrate composition, which is otherwise preferred. For example, at some concentrations, preferred polymeric organic sequestering agents and some preferred alkalinizing components can not be jointly solubilized. The two components are then placed in separate packages with other portions of the formulation so that stable solutions or dispersions can be formed after mixing and dilution. A two package concentrate system has some advantages in that the two components can be mixed in different proportions to provide more effective cleaning for particular soils, soil combinations, and/or types of substrate to be cleaned.

Process embodiments of the invention include at a minimum using a working composition according to the invention to remove soils from a metal substrate, and they may include other process steps, particularly those which are conventional in themselves preceding or following vapor degreasing in the prior art.

Compositions of the present invention are particularly useful for cleaning aluminum substrates, but are also useful for cleaning articles fabricated from metals such as steel, stainless steel, magnesium, titanium, tantalum, and other metals which are machined or worked during their fabrication into useful articles.

The composition and the method of the present invention, especially in their preferred embodiments, can provide removal of oily, greasy, and/or waxy residue from metal substrates to meet Boeing Aircraft Corporation ("BAC") 5763 PSD-6-14 criteria. Boeing Aircraft Corporation criteria requires the removal of all light oil (3-IN-1™ Oil), lipstick, axle grease, COSMOLENE™, black SHARPIE™ marker, red MAGIC MARKER™, BAYCO™ 363, CINFLO™, STAYPUT™ 350, CYTAL™ 81, MEROPA™ 460 and HD32 WAY OIL™ from the metal surface. The most preferred embodiments of the present invention can remove the above soils, meet the requirement for maximum etching weight loss on seven different substrates, meet the requirement of the sandwich corrosion versus DURCLEAN™ 281 test, meet requirements for avoiding inter-granular attack, corrosion resistance, paint adhesion, avoiding hydrogen embrittlement (steel), stress corrosion cracking, hydrogen content, and operating bath temperature. However, compositions of the present invention can be particularly useful even when requirements for cleaning are not as stringent as those in the Boeing BAC 5763 criteria.

In addition to the required materials, the composition of the present invention can additionally contain chelating or sequestering agents, germicides, preserving agents and the like.

The composition of the present invention does not generally require the presence of a foam suppressing agent. Normally, all the surfactants in a composition according to the invention are preferably low foaming surfactants, but medium foaming and high foaming surfactants can be utilized if the foam does not present a problem in a particular operation. Generally, if the metal articles are to be degreased by immersion in the degreasing solution, the use of low foaming surfactants is not required. However, if the degreasing solution is to be sprayed on the metal articles, it is generally useful to prepare the degreasing compositions from low-foaming or moderate-foaming surfactant materials.

DESCRIPTION OF PREFERRED EMBODIMENTS

In a working composition according to the invention, the pH preferably is, with increasing preference in the order given, not less than 6.5, 7.0, 7.2, 7.4, 7.6, 7.8, 8.0, 8.2, 8.3, or 8.4 and independently preferably is, with increasing preference in the order given, not more than 12.5, 12.0, 11.5, 11.0, 10.8, 10.6, 10.4, 10.2, 10.0, 9.8, 9.6, 9.4, 9.2, 9.0, 8.9, 8.8, 8.7, or 8.6.

The nonionic surfactants required for components (A) and (B) can be block copolymers of propylene oxide and ethylene oxide, ethoxylated or ethoxylated and propoxylated fatty alcohols, ethoxylated or ethoxylated and propoxylated alkyl phenols, ethoxylated alkyl or aryl moieties, all of which can be modified by capping the terminal ethoxy or propoxy group with a low molecular weight capping moiety generally having 1 to 4 carbon atoms; fatty acid and fatty alcohol esters, particularly monoesters of a fatty acid with glycerol or polyglycerol; fatty amines, ethoxylated fatty amines, ethoxylated monoglycerides and diglycerides, alkyl glycosides and the like. Preferably, the nonionic surfactants utilized in the practice of the present invention are stable and soluble in alkaline solutions.

Suitable commercially available nonionic surfactants with an HLB from about 6 to 9.5 for use in component (A) as defined above are TERGITOL™ TMN-3, PLURONIC™ L72, ICONOL™ DNP-4, PLURONIC™ L-62 LF, GLUXABEAN™ B-13, ALKASURF™ LA-EP15, ALKASURF™ S-5, ALKATRONIC™ EDP 28-2, PLURAFAC™ RA-40, NEODOL™ 25-3, ALKASURF™ LA3, SURFONIC™ N40, PLURAFAC™ RA-30 and the like. Component (A) is preferably selected from molecules conforming to general chemical formula II:

$$H_{(2a+1-b)}F_bC_a—O—(C_mH_{2m}O)_p—H \quad \text{(II)},$$

wherein a represents a positive integer that is at least 6 and preferably is, with increasing preference in the order given, at least 8, 10, or 12 and that independently is not more than 22 and preferably is, with increasing preference in the order given, not more than 20, 18, 16, or 14; b represents 0 or a positive integer that is not more than (2a+1) and preferably is, with increasing preference in the order given, not more than 40, 30, 20, 10, 5, 4, 3, 2, 1, or 0; m represents a positive integer that is at least 2 and is not more than 4, preferably not more than 3, most preferably exactly 2; and p represents a positive integer chosen so that, in the average for the component, the HLB value is not less than 3 and preferably is, with increasing preference in the order given, not less than 5, 6, 6.5, 7.0, 7.2, 7.4, 7.6, 7.7, 7.8, 7.9, or 8.0 and independently is not more than 9.5 and preferably, with increasing preference in the order given, is not more than 9.4, 9.2, 9.0, 8.9, 8.8, 8.7, 8.6, 8.5, 8.4, 8.3, or 8.2. Independently of the other preferences, component (A) is most preferably selected from molecules conforming to general formula II when the $H_{(2a+1-b)}F_bC_a$ moiety is:

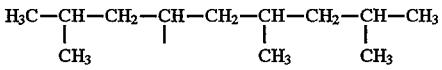

The concentration of component (A)in a working composition according to the invention preferably is, with increasing preference in the order given, not less than 0.1, 0.2, 0.4, 0.8, 1.2, 1.6, 2.0, 2.2, 2.4, 2.6, 2.7, 2.8, or 2.9 grams per liter (hereinafter usually abbreviated as "g/L") and independently preferably is not more than 50, 30, 20, 15, 10, 8, 7.0, 6.5, 6.0, 5.7, 5.4, 5.1, 4.9, 4.8, 4.7, or 4.6 g/L.

Suitable commercially available nonionic surfactants with an HLB of from above 9.5 to about 16 for use in component (B) as defined above include materials such as MACOL™ OLA-4, ALKASURF™ LA-EP45, FLO MO™ 6 D, PLUROFAC™ R AR20, ALKASURF™ OP-5, TRITON™ DF-12, ALKAMUL™ 400 MO, TRITON™ DF-18, TERGITOL™ TMN-6, PLURONIC™ L43, NEODOL™ 25-7, TRITON™ N-87, and the like. Component (B) is preferably selected from molecules conforming to general chemical formula III:

$$H_{(2a+1-b)}F_bC_a—O—(C_mH_{2m}O)_q—H \quad \text{(III)},$$

wherein a, b, and m have the same meanings as given above for formula II and q represents a positive integer chosen so that, in the average for the component, the HLB value is not less than 3 and preferably is, with increasing preference in the order given, not less than 9.6, 10.1, 10.6, 10.8, 11.0, 11.2, 11.3, 11.4, 11.5 or 11.6 and independently is not more than 16 and preferably, with increasing preference in the order given, is not more than 15, 14, 13.5, 13.2, 13.0, 12.8, 12.6, 12.4, 12.2, 12.1, 12.0, 11.9, or 11.8. Independently of the other preferences, component (B) is most preferably selected from molecules conforming to general formula III when the $H_{(2a+1-b)}F_bC_a$ moiety is:

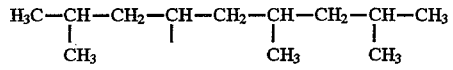

The concentration of component (B) in a working composition according to the invention preferably is, with increasing preference in the order given, not less than 0.03, 0.07, 0.13, 0.26, 0.4, 0.50, 0.60, 0.65, 0.70, 0.75, 0.80. 0.83, 0.86, 0.89, 0.91, 0.93, or 0.95 g/L and independently preferably is not more than 20, 15, 10, 8, 7.0, 6.0, 5.5, 5.0, 4.5, 4.0, 3.5, 3.0, 2.7, 2.4, 2.1, 1.9, 1.8, 1.7, or 1.6 g/L. Independently of the other preferences, the ratio of the concentration of component (B) to the concentration in the same units of component (A) preferably is, with increasing preference in the order given, at least 0.03:1.0, 0.06:1.0, 0.09:1.0, 0.12:1.0, 0.15:1.0, 0.18:1.0, 0.21:1.0, 0.24:1.0, 0.26:1.0, 0.28:1.0, 0.29:1.0, 0.30:1.0, 0.31:1.0, 0.32:1.0, or 0.33:1.0 and independently preferably is, with increasing preference in the order given, not more than 3.0:1.0, 2.5:1.0, 2.0:1.0, 1.5:1.0, 1.0:1.0, 0.90:1.0, 0.80:1.0, 0.70:1.0, 0.60:1.0, 0.50:1.0, 0.45:1.0, 0.42:1.0, 0.40:1.0, 0.38:1.0, 0.37:1.0, 0.36:1.0, 0.35:1.0, or 0.34:1.0.

Component (C) as described above is preferably selected from molecules conforming to general formula IV:

$$Q—O—(c_sH_{(2s-c)}F_cO)_r—Cl \quad \text{(IV)},$$

wherein Q represents either H or Cl; s, which may be the same or different from one to another of the $(C_kH_{(2k-c)}F_cO)$ groups, is 2, 3, or 4, preferably 2 or 3, or more preferably 2 in some but not all of the $(C_kH_{(2k-c)}F_cO)$ groups and 3 in the remaining $(C_kH_{(2k-c)}f_cO)$ groups in each molecule; c is 0 or a positive integer not greater than 2s and more preferably, with increasing preference in the order given, is not greater than 6, 5, 4, 3, 2, 1, or 0; and r, which may be different from one molecule to another in the component to another, is a positive integer, the value or values of r, c, and s being selected so that the average HLB value for the component as a whole is not less than 8 and more preferably, with increasing preference in the order given, is not less than 8.5, 9.0, 9.5, 10.0, 10.5, 10.9, 11.3, 11.6, 11.9, 12.2, 12.3, or 12.4 and independently preferably is, with increasing preference in the order given, not more than 17, 16, 15, 14.5, 14.0, 13.7, 13.4, 13.1, 12.9, 12.8, 12.7, or 12.6.

The concentration of component (C) in a working composition according to the invention preferably is, with increasing preference in the order given, not less than 0.03, 0.07, 0.13, 0.26, 0.4, 0.50, 0.60, 0.65, 0.70, 0.75, 0.80, 0.83, 0.86, 0.87, 0.88, or 0.89 g/L and independently preferably is not more than 30, 20, 15, 10, 8, 7.0, 6.0, 5.5, 5.0, 4.5, 4.0, 3.5, 3.0, 2.8, 2.6, 2.4, 2.3, 2.2, or 2.1 g/L. Independently of the other preferences, the ratio of the concentration of component (C) to the concentration in the same units of component (A) preferably is, with increasing preference in the order given, at least 0.03:1.0, 0.06:1.0, 0.09:1.0, 0.12:1.0, 0.15:1.0, 0.18:1.0, 0.21:1.0, 0.24:1.0, 0.26:1.0, 0.28:1.0, 0.29:1.0, 0.30:1.0, 0.31:1.0, 0.32:1.0, or 0.33:1.0 and independently preferably is, with increasing preference in the order given, not more than 5.0:1.0, 4.0:1.0, 3.0:1.0, 2.5:1.0, 2.0:1.0, 1.5:1.0, 1.0:1.0, 0.90:1.0, 0.80:1.0, 0.70:1.0, 0.65:1.0, 0.62:1.0, 0.59:1.0, 0.56:1.0, 0.53:1.0, 0.52:1.0, or 0.51:1.0.

Component (D)(i) preferably is selected from ethylene, propylene, and butylene glycols, more preferably ethylene glycol and propylene glycol. In a working composition according to the invention, the concentration of component (D)(i) as described above preferably is, with increasing preference in the order given, not less than 0.5, 1.0, 1.5, 2.0, 2.5, 3.0, 3.3, 3.6, 3.8, 3.9, 4.0, or 4.1 g/L of components satisfying the description of (D)(i) and independently preferably is not more than 100, 75, 50, 40, 30, 25, 22, 20, 19, 18, 17, 16, or 15 g/L. Independently of the other preferences, the ratio of the concentration of component (D)(i) to the concentration in the same units of component (A) preferably is, with increasing preference in the order given, at least 0.50:1.0, 1.0:1.0, 1.5:1.0, 2.0:1.0, 3.0:1.0, 4.0:1.0, 5.0:1.0, 6.0:1.0, 7.0:1.0, 8.0:1.0, 9.0:1.0, 10:1.0, 11:1.0, 12:1.0, 13:1.0, or 14:1.0 and independently preferably is, with increasing preference in the order given, not more than 300:1.0, 200:1.0, 150:1.0, 100:1.0, 90:1.0, 80:1.0, 70:1.0, 65:1.0, 60:1.0, 58:1.0, 56:1.0, 54:1.0, 52:1.0, 50:1.0, 48:1.0, or 47:1.0.

It is preferable for a composition according to the invention to contain at least two of components (D)(i), (D)(ii), and (D)(iii) as described above, but irrespective of whether a composition according to the invention contains component (D)(i) or (D)(iii) as described above, it preferably contains component (D)(ii) as described above, and in a working composition according to the invention, the concentration of component (D)(ii) preferably is, with increasing preference in the order given, not less than 1.0, 2.0, 3.0, 4.0, 4.5, 5.0, 5.5, 5.7, or 5.9 g/L of components satisfying the description of (D)(ii) and independently preferably is not more than 50, 40, 30, 25, 20, 18, 16, 14, 12, 10.5, 9.5, 9.0, 8.7, or 8.5 g/L. Independently of the other preferences, the ratio of the concentration in g/L of component (D)(ii) to the concentration in g/L of component (A) preferably is, with increasing preference in the order given, at least 0.20:1.0, 0.30:1.0, 0.40:1.0, 0.50:1.0, 0.60:1.0, 0.80:1.0, 1.0:1.0, 1.2:1.0, 1.4:1.0, 1.6:1.0, 1.7:1.0, 1.8:1.0, or 1.9:1.0 and independently preferably is, with increasing preference in the order given, not more than 30:1.0, 20:1.0, 15:1.0, 10:1.0, 9.0:1.0, 8.0:1.0, 7.0:1.0, 6.0:1.0, 5.5:1.0, 5.0:1.0, 4.5:1.0, 4.0:1.0, 3.6:1.0, 3.3:1.0, 3.0:1.0, 2.8:1.0, or 2.7:1.0. Independently, it is preferred that component (D)(ii) be selected from molecules conforming to general formula V:

$$H_{(2c+1-d)}F_dC_c—O—(C_kH_{2k}O)—(C_jH_{2j}O)—H \qquad (V),$$

wherein c represents a positive integer; d represents zero or a positive integer that is not more than (2c+1) and preferably is, with increasing preference in the order given, not more than 8, 5, 4, 3, 2, 1, or 0; each of j and k, which may be the same or different, represents a positive integer that is at least 2 and is not more than 4, preferably not more than 3, most preferably exactly 2; and the sum c+j+k preferably is, with increasing preference in the order given, at least 6, 7, or 8 and independently preferably is, with increasing preference in the order given, not more than 20, 18, 16, 14, 12, 10, or 9. The single most preferred compound for component (D)(ii) is the monobutyl ether of diethyleneglycol, i.e., $C_4H_9$—O—$C_2H_4$—O—$C_2H_4$OH.

If optional component (D)(iii) as defined above is used in a composition according to the invention, it preferably is selected from the group of N-alkyl-2-pyrrolidones in which the alkyl group is preferably straight chain and preferably has, with increasing preference in the order given, at least 2, 3, 4, 5, 6, 7, or 8 carbon atoms and independently preferably has, with increasing preference in the order given, not more than 30, 20, 18, 16, 14, 12, 11, 10, or 9 carbon atoms. If component (D)(iii) is used, its concentration in a working composition preferably is, with increasing preference in the order given, not less than 0.1, 0.2, 0.4, 0.8, 1.2, 1.4, 1.6, 1.8, 2.0, 2.1, 2.2, 2.3, or 2.4 g/L and independently preferably is, with increasing preference in the order given, not more than 50, 25, 15, 10, 8, 6, 5, 4.0, 3.5, 3.2, 2.9, 2.8, 2.7, or 2.6 g/L.

The most important preferred chemical characteristic of alkalinizing component (E) as described above is that it should act together with all the other components to produce a pH in a working composition as specified above. The alkalinizing component is preferably selected from various inorganic salts and hydroxides known to be useful as "inorganic builders" in cleaning formulations generally. Inorganic builders, except for hydroxides, are generally salts of polyfunctional inorganic acids, such as alkali metal silicates, alkali metal borates, alkali metal carbonates, alkali metal sulfates, alkali metal polyphosphates, alkali metal phosphates, alkali metal orthophosphates, and alkali metal pyrophosphates. Salts such as sodium silicate, sodium metasilicate, sodium orthosilicate, sodium tetraborate, sodium borate, sodium sulfate, sodium carbonate, trisodium phosphate, disodium orthophosphate, sodium metaphosphate, sodium pyrophosphate, and the equivalent potassium salts and sodium and potassium hydroxides and the like are all suitable alkalinizing agents for compositions according to the present invention. Lithium, rubidum, and cesium salts and hydroxides are also suitable, although usually less preferred because of their higher cost, and ammonium salts are technically suitable but are generally avoided because of the chance of loss by volatilization and the accompanying odor nuisance of ammonia fumes. When concentrates suitable for dilution with at least nine times their own mass of water are to be prepared, potassium salts and hydroxide are preferred over sodium for at least part of the alkalinizing agent, because of the greater solubility of the potassium compounds and their greater compatability with nonionic surfactants.

If the pH of a working composition is greater than 9.0 and the composition is to be used for cleaning most high-aluminum alloys, it is highly preferred to include some silicate in component (E), in order to avoid the corrosion of aluminum that is likely to result otherwise under such high pH conditions. In particular, in a working composition with a pH higher than 9, the concentration of alkali metal silicate preferably is sufficiently high that the molar ratio of the stoichiometric equivalent as $SiO_2$ of the silicon in the silicate to the stoichiometric equivalent as alkali metal oxide of the total of (i) the alkali metal content in the alkali metal silicate and (ii) any unneutralized alkali metal hydroxide present in the working composition preferably is, with increasing preference in the order given, at least 0.02, 0.04, 0.08, 0.16, 0.20, 0.24, 0.26, 0.28, 0.29, 0.30, or 0.31 and independently preferably is, with increasing preference in the order given, not greater than 1, 0.9, 0.8, 0.7, 0.6, 0.50, or 0.40.

For removal of the widest variety of commonly encountered types of soils on metal surfaces, it is preferred that compositions according to the invention include optional component (F). A wide variety of anionic and amphoteric surfactants are suitable, but two types are particularly preferred: (i) N-alkylaminocarboxylic acids and their salts and (ii) anionic surfactants including a polyoxyethylene block in their molecular structure. If component (F) is used, its concentration in a working composition preferably is, with increasing preference in the order given, not less than 0.01, 0.02, 0.04, 0.08, 0.15, 0.30, 0.50, 0.60, 0.70, 0.80, 0.83, 0.85, 0.87, 0.89, 0.91, 0.93, 0.95, 0.97, or 0.99 g/L and independently preferably is, with increasing preference in the order given, not more than 50, 25, 15, 10, 8, 6, 5, 4.1, 3.7, 3.3, or 3.1 g/L.

The presence of optional component (G) is generally preferred in concentrates according to the invention with a concentrate pH higher than 10, because it is difficult to prepare stable concentrates as alkaline as this with all the other desired ingredients unless hydrotroping agents are also present. Conventional hydrotroping agents such as the salts of alkyl benzene sulfonic acids, particularly of cumene sulfonic acid, are suitable for compositions to accomplish the cleaning purposes of this invention, but because of the later intended use of the substrates to be cleaned, very low tolerances for residual sulfur on the surface are specified for many aerospace applications. Two other types of hydrotropes are therefore preferred for most formulations according to this invention: (i) organic phosphate esters and (ii) alkyl and alkenyl substituted cyclic acid anhydrides, particularly the anhydrides of $C_{4-6}$ terminal dicarboxylic acids substituted with alkyl or alkenyl groups having 6 to 20 carbon atoms. A particularly preferred example of this type of hydrotrope is nonenyl succinic anhydride. These two types are even more preferred in combination with each other, in a ratio of type (i) to type (ii) that preferably is, with increasing preference in the order given, at least 0.1, 0.2, 0.4, 0.6, 0.80, 0.90, 1.00, 1.10, 1.20, 1.30, 1.40, 1.50, or 1.55 and independently preferably is, with increasing preference in the order given, not more than 20, 15, 10, 7, 5, 4, 3, 2.7, 2.4, 2.2, 2.0, 1.9, 1.8, 1.75, 1.70, or 1.65. The amount of hydrotroping agent is not believed to be critical, but in a highly alkaline concentrate with other components at their most preferred levels, the total amount of hydrotroping agent preferably is, with increasing preference in the order given, at least 5, 25, or 50 gel and independently preferably is, with increasing preference in the order given, not more than 150, 90, or 70 g/L. In concentrates or working compositions of lower pH, hydrotroping agent can satisfactorily be omitted altogether.

Essentially any organic material known to have a corrosion inhibiting effect on aluminum may be utilized in optional component (H) according to the invention as described above. The organic corrosion inhibitors most useful in the practice of the present invention are generally nitrogen or oxygen containing organic compounds, such as amines, vitro compounds, imidazoles, diazoles, triazoles, carboxylic acids, and the like. Particularly preferred inhibitors are (i) aromatic triazoles and their salts and (ii) MAZON™ RI-263 corrosion inhibitor, a product of proprietary structure obtained commercially from PPG Corp., Specialty Chemicals Business Unit, Gurnee, Ill., preferably in a ratio of type (i) to type (ii) that is, with increasing preference in the order given, from 1:1–20:1, 3:1–10:1, or 4.5:1.0–5.5:1.0. When component (H) is present in a working composition according to this invention, its concentration preferably is, with increasing preference in the order given, at least 0.001, 0.002, 0.004, 0,008, 0.015, 0.030, 0.060, 0.12, 0.25, 0.35, 0.40, 0.45, 0.48, 0.52, 0.55, or 0.58 g/L and independently preferably is, with increasing preference in the order given, not more than 20, 10, 5, 4.5, 4.0, 3.6, 3.2, 2.8, 2.4, 2.0, 1.9, 1.8, 1.7, or 1.6 g/L.

The presence of optional component (J) in all compositions according to the invention is generally preferred. Any material recognized in the art as a sequestering agent for aluminum, calcium, and/or magnesium cations in aqueous solution may be used. A particularly preferred type of sequestering agent that is denoted "(J)(i)" below is a polycarboxylate copolymer of the type generally available commercially and often known as an "organic builder". Materials such as Polymer QR1362-PMN and ACUSOL™ 102, both from Rohm and Haas, have been found to be useful in the practice of the present invention. Other preferred sequestering agents that are denoted (J)(ii) below include all sufficiently water-soluble organic acids, and salts of acids, that contain at least two-OH moieties (which may or may not be part of carboxyl moieties) positioned within the acid molecule in such a way as to be capable of forming a five-membered or larger ring structure in a coordination compound with a metal ion. Common examples of such acids include nitrilotriacetic acid ("NTA"), ethylene diamine tetraacetic acid ("EDTA"), and, particularly preferred, citric acid. In a working composition according to this invention, the concentration of polycarboxylate copolymer preferably is, with increasing preference in the order given, at least 0.1, 0.2, 0.4, 0.8, 1.5, 2.0, 2.5, 2.8, 3.1, 3.4, 3.6, 3.7, 3.8, 3.9, 4.0, or 4.1 g/L and independently preferably is, with increasing preference in the order given, not more than 100, 50, 38, 28, 24, 20, 16, 14, 13, 12, or 11 g/L. Independently, the total concentration of all sequestering agents preferably is, with increasing preference in the order given, not more than 100, 50, 38, 28, 24, 20, 16, 14, 13, or 12 g/L.

For commercial sales, at least one concentrate is generally prepared which when diluted with water provides the composition of the present invention which is actually utilized to degrease the metal articles. The concentrates preferably are prepared so that, when they are diluted with from 2 to 20 times their own mass with water, a suitable working degreasing composition is formed. For certain highly desirable working compositions, it is not possible to prepare a stable corresponding concentrate as a single mixture, particularly when a concentrate suitable for diluting with at least nine times its own mass of water is desired, as is usually preferred. In such cases, it is preferable to prepare two mixtures which are both added to the diluting water to form a stable composition for degreasing the metal articles. When the concentrate is provided as two mixtures (two package system), it can provide flexibility: The two mixtures can be used in different proportions, adjusted to meet special degreasing problems.

Strongly alkaline working compositions, which as already noted above generally need substantial amounts of silicates in the compositions, have been found particularly difficult to prepare from stable one package concentrates, because silicates and many nonionic surfactants are difficult to solubilize together in high concentrations. When two packages are needed, therefore, it is advantageous to include substantially all of the silicate desired in one of the packages, which contains little or no nonionic surfactant, but usually does contain some of the other alkalinizing agents and organic solvents.

In one preferred two package embodiment of the invention, the surfactant containing concentrate package preferably consists essentially of, or more preferably consists of, water and the following components:

with increasing preference in the order given, at least 0.1, 0.2, 0.4, 0.8, 1.5, 1.8, 2.0, 2.2, 2.4, 2.6, 2.7, 2.8, 2.85, 2.90, or 2.95, and, independently, with increasing preference in the order given, not more than 30, 25, 20, 15, 10, 7.0, 5.0, 4.5, 4.0, 3.7, 3.5, 3.3, 3.2, 3.1, or 3.05, % of component (A) as defined above;

with increasing preference in the order given, at least 0.03, 0.07, 0.13, 0.27, 0.5, 0.6, 0.7, 0.8, 0.85, 0.90, or 0.95, and, independently, with increasing preference in the order given, not more than 10, 8, 6.0, 5.0, 4.0, 3.0, 2.5, 2.0, 1.7, 1.5, 1.3, 1.2, 1.1, or 1.05, % of component (B) as defined above;

with increasing preference in the order given, at least 0.05, 0.1, 0.2, 0.4, 0.7, 0.9, 1.0, 1.1, 1.2, 1.3, 1.40, 1.43, or 1.45, and, independently, with increasing preference in the order given, not more than 15, 12, 10, 7, 5.0, 4.5, 3.7, 2.5, 1.8, 1.65, 1.60, or 1.55, % of component (C) as defined above;

with increasing preference in the order given, at least 0.20, 0.56, 1.0, 2.0, 2.6, 3.1, 3.5, 3.8, 4.1, or 4.15, and, independently, with increasing preference in the order given, not more than 42, 32, 26, 21, 16, 13, 10.5, 8.9, 7.4, 5.8, 5.2, 4.7, 4.5, 4.4, 4.3, or 4.25, % of component (D)(i) as defined above;

with increasing preference in the order given, at least 0.24, 0.56, 1.0, 1.5, 2.4, 5.0, 6.0, 7.0, 7.25, 7.65, or 7.95, and, independently, with increasing preference in the order given, not more than 80, 60, 50, 40, 30, 25, 20, 17, 14, 11, 10, 9.0, 8.5, 8.2, 8.1, or 8.05, % of component (D)(ii) as defined above;

with increasing preference in the order given, at least 0.02, 0.05, 0.12, 0.16, 0.29, 0.36, 0.42, 0.47, 0.51, 0.54, or 0.55, and, independently, with increasing preference in the order given, not more than 6, 5, 3.6, 3.0, 2.4, 1.8, 1.5, 1.2, 1.0, 0.9, 0.80, 0.72, 0.68, or 0.65, moles per kilogram (hereinafter usually abbreviated "M/kg") of alkali metal hydroxide, part of component (E) as defined above;

with increasing preference in the order given, at least 0.004, 0.008, 0.014, 0.02, 0.04, 0.06, 0.07, 0.08, 0.09, 0.10, 0.11, or 0.115, and, independently, with increasing preference in the order given, not more than 1.3, 0.85, 0.60, 0.45, 0.35, 0.27, 0.22, 0.19, 0.17, 0.15, 0.14, 0.13, or 0.125, M/kg of alkali metal salts, exclusive of silicates, of multifunctional inorganic acids, part of component (E) as defined above;

with increasing preference in the order given, at least 0.06, 0.14, 0.26, 0.54, 1.0, 1.2, 1.4, 1.6, 1.7, 1.8, 1.9, or 1.95, and, independently, with increasing preference in the order given, not more than 20, 10, 7.0, 5.0, 3.0, 2.7, 2.4, 2.2, 2.1, or 2.05, % of component (F) as defined above;

with increasing preference in the order given, at least 0.12, 0.28, 0.52, 1.3, 2.0, 2.4, 2.8, 3.2, 3.50, 3.75, 3.90, or 3.95, and, independently, with increasing preference in the order given, not more than 40, 32, 24, 20, 16, 12, 10, 8.0, 6.8, 6.0, 5.2, 4.4, 4.1, or 4.05, % of component (G)(i) as defined above;

with increasing preference in the order given, at least 0.07, 0.14, 0.28, 0.5, 0.7, 1.0, 1.5, 1.8, 2.0, 2.2, 2.3, 2.40, or 2.45, and, independently, with increasing preference in the order given, not more than 25, 20, 16, 12, 10, 8.0, 6.8, 3.5, 2.9, 2.7, 2.6, or 2.55, of component (G)(ii) as defined above;

with increasing preference in the order given, at least 0.003, 0.007, 0.013, 0.027, 0.05, 0.06, 0.07, 0.08, 0.085, 0.090, or 0.095, and, independently, with increasing preference in the order given, not more than 1, 0.8, 0.60, 0.50, 0.40, 0.30, 0.25, 0.20, 0.17, 0.15, 0.13, 0.12, 0.11, or 0.105, % of component (H)(i) as defined above;

with increasing preference in the order given, at least 0.015, 0.035, 0.07, 0.13, 0.25, 0.30, 0.35, 0.40, 0.45, 0.47, or 0.49, and independently, with increasing preference in the order given, not more than 5, 4, 3, 2.5, 2.0, 1.5, 1.3, 1.0, 0.85, 0.65, 0.58, 0.54, 0.52, or 0.51, % of component (H)(ii) as defined above; and with increasing preference in the order given, at least 0.20, 0.56, 1.0, 2.0, 2.6, 3.1, 3.5, 3.8, 4.1, or 4.15, and, independently, with increasing preference in the order given, not more than 42, 32, 26, 21, 16, 13, 10.5, 8.9, 7.4, 5.8, 5.2, 4.7, 4.5, 4.4, 4.3, or 4.25, % of component (J)(i) as defined above.

The second package of this preferred two-package embodiment consists essentially of, or preferably consists of, water and:

with increasing preference in the order given, at least 0.24, 0.56, 1.0, 2.4, 5.0, 6.0, 7.0, 7.25, 7.65, or 7.95, and, independently, with increasing preference in the order given, not more than 80, 60, 50, 40, 30, 25, 20, 17, 14, 11, 10, 9.0, 8.5, 8.2, 8.1, or 8.05, % of component (D)(ii) as defined above;

with increasing preference in the order given, at least 0.012, 0.03, 0.072, 0.11, 0.17, 0.22, 0.25, 0.30, 0.32, 0.34, or 0.35, and, independently, with increasing preference in the order given, not more than 3.6, 3.0, 2.2, 1.8, 1.4, 1.1, 0.90, 0.72, 0.60, 0.54, 0.48, 0.43, 0.40, or 0.37, M/kg of alkali metal hydroxide, part of component (E) as defined above;

with increasing preference in the order given, at least 0.06, 0.14, 0.26, 0.54, 1.0, 1.2, 1.4, 1.6, 1.7, 1.8, 1.85, or 1.90, and, independently, with increasing preference in the order given, not more than 20, 10, 7.0, 5.0, 3.0, 2.7, 2.4, 2.2, 2.1, or 2.0, % of alkali metal silicate, part of component (E) as defined above;

with increasing preference in the order given, at least 0.007, 0.017, 0.035, 0.065, 0.12, 0.15, 0.18, 0.20, 0.22, 0.23, or 0.24, and, independently, with increasing preference in the order given, not more than 3, 2, 1.5, 1.25, 1.00, 0.85, 0.70, 0.60, 0.5, 0.42, 0.32, 0.30, 0.28, 0.27, or 0.26, % of component (H)(i) as defined above; and with increasing preference in the order given, at least 0.015, 0.035, 0.07, 0.13, 0.25, 0.30, 0.35, 0.40, 0.45, 0.47, or 0.49, and, independently, with increasing preference in the order given, not more than 5, 4, 3, 2.5, 2.0, 1.5, 1.3, 1.0, 0.85, 0.65, 0.58, 0.54, 0.52, or 0.51, % of component (H)(ii) as defined above.

A preferred single package concentrate embodiment of the invention consists essentially of, or preferably consists of, water and:

with increasing preference in the order given, at least 0.1, 0.2, 0.4, 0.8, 1.5, 1.8, 2.0, 2.2, 2.4, 2.6, 2.7, 2.8, 2.85, 2.90, or 2.95, and, independently, with increasing preference in the order given, not more than 30, 25, 20, 15, 10, 7.0, 5.0, 4.5, 4.0, 3.7, 3.5, 3.3, 3.2, 3.1, or 3.05%, of component (A) as defined above;

with increasing preference in the order given, at least 0.03, 0.07, 0.13, 0.27, 0.5, 0.6, 0.7, 0.8, 0.85, 0.90, or 0.95, and, independently, with increasing preference in the order given, not more than 10, 8, 6.0, 5.0, 4.0, 3.0, 2.5, 2.0, 1.7, 1.5, 1.3, 1.2, 1.1, or 1.05, % of component (B) as defined above;

with increasing preference in the order given, at least 0.03, 0.07, 0.13, 0.27, 0.5, 0.6, 0.7, 0.8, 0.85, 0.90, or 0.95, and, independently, with increasing preference in the order given, not more than 10, 8, 6.0, 5.0, 4.0, 3.0, 2.5, 2.0, 1.7, 1.5, 1.3, 1.2, 1.1, or 1.05, % of component (C) as defined above;

with increasing preference in the order given, at least 1.4, 3, 5, 7, 9, 11, 12, 13, 13.5, 13.8, or 13.9, and, independently, with increasing preference in the order given, not more than 40, 30, 20, 17, 15, 14.6, 14.3, or 14.1, % of component (D)(i) as defined above;

with increasing preference in the order given, at least 0.16, 0.33, 0.66, 1.0, 2.0, 3.0, 4.0, 4.7, 5.2, 5.6, or 5.9, and, independently, with increasing preference in the order given, not more than 60, 45, 30, 25, 20, 17, 14, 11, 9.0, 8.0, 7.5, 7.0, 6.7, 6.4, or 6.1, % of component (D)(ii) as defined above;

with increasing preference in the order given, at least 0.07, 0.14, 0.28, 0.5, 1.0, 1.5, 1.8, 2.0, 2.2, 2.3, 2.40, or 2.45, and, independently, with increasing preference in the order given, not more than 25, 20, 16, 12, 10, 8.0, 6.8, 3.5, 2.9, 2.7, 2.6, or 2.55, % of component (D)(iii) as defined above;

with increasing preference in the order given, at least 0.07, 0.14, 0.20, 0.30, 0.40, 0.50, 0.60, 0.65, 0.70, 0.73, or 0.75, and, independently, with increasing preference in the order given, not more than 3.6, 3.0, 2.2, 1.8, 1.4, 1.1, 1.0, 0.95, 0.90, 0.87, 0.85, 0.83, 0.81, 0.79, or 0.77, M/kg of alkali metal hydroxide, part of component (E) as defined above;

with increasing preference in the order given, at least 0.03, 0.06, 0.12, 0.20, 0.30, 0.40, 0.53, 0.65, 0.75, 0.85, 0.90, or 0.95, and, independently, with increasing preference in the order given, not more than 10, 5, 3.5, 2.5, 2.0, 1.7, 1.4, 1.2, 1.1, or 1.05, % of component (F) as defined above;

with increasing preference in the order given, at least 0.015, 0.035, 0.07, 0.13, 0.25, 0.30, 0.35, 0.40, 0.45, 0.47, or 0.49, and, independently, with increasing preference in the order given, not more than 5, 4, 3, 2.5, 2.0, 1.5, 1.3, 1.0, 0.85, 0.65, 0.58, 0.54, 0.52, or 0.51, % of component (H)(i) as defined above;

with increasing preference in the order given, at least 0.03, 0.08, 0.17, 0.26, 0.50, 0.60, 0.70, 0.80, 0.90, 0.94, or 0.95, and, independently, with increasing preference in the order given, not more than 10, 8, 6, 5, 4, 3, 2.5, 2.0, 1.7, 1.3, 1.2, 1.15, 1.10, or 1.05, % of component (H)(ii) as defined above;

with increasing preference in the order given, at least 1, 2, 4, 5, 6, 6.5, 7.0, 7.5, 8.0, 8.5, 9.3, 9.7, or 9.9, and, independently, with increasing preference in the order given, not more than 42, 32, 29, 26, 23, 20, 17, 14, 12, 11, 10.5, 10.3, or 10.1, % of component (J)(i) as defined above; and with increasing preference in the order given, at least 0.05, 0.1, 0.2, 0.4, 0.7, 0.9, 1.0, 1.1, 1.2, 1.3, 1.40, 1.50, or 1.65, and, independently, with increasing preference in the order given, not more than 17, 13, 10, 8, 6, 4.5, 3.7, 2.5, 2.2, 1.95, 1.85, 1.75, or 1.70, of component (J)(ii) as defined above.

Metal articles to be degreased should be contacted with the aqueous degreasing composition of the present invention at a sufficient temperature for a sufficient time to be effective for degreasing. For removing average type soils, the temperature during contact preferably is, with increasing preference in the order given, not less than 20, 25, 28, 30, 32, 34, or 36° C. and independently preferably is, with increasing preference in the order given, not more than 80, 75, 70, 65, 60, 55, 50, 45, or 40° C. Higher temperatures generally provide a more rapid degreasing and can be necessary when the soil comprises high melting point waxy type materials. Under normal conditions, the time of contact between the metal to be degreased and the working composition according to this invention preferably is, with increasing preference in the order given, not less than 1, 2, 4, 8, 10, 12, 13, or 14 minutes and independently preferably is, with increasing preference in the order given, not more than 120, 90, 60, 50, 40, 30, 27, 24, 22, 20, 18, or 16 minutes.

The compositions and processes of the present invention are particularly useful to replace vapor degreasing of aluminum articles for use in the aerospace industry. However, the compositions and processes of the present invention are not limited to degreasing of aluminum articles but can be applied to steel, stainless steel, magnesium and magnesium alloys, titanium, tantalum, and the numerous alloys which are utilized in rail cars, aircraft, missiles, space vehicles and the like. The compositions of the present invention can be utilized to degrease and clean extruded aluminum and magnesium articles, forged steel, stainless steel, machined articles such as engine blocks, auto transmission parts, rocket fuel tanks, aircraft panels, and other metal articles which have been machined and require degreasing before they can be assembled or a protective coating applied.

As is well understood in the art, after a vapor degreasing operation or contact with the composition of the present invention to degrease the article, the article can be processed in other usual steps such as alkaline or acid cleaning, deoxidizing, conversion coating, a conversion-coating-improving wash coat or "sealer", such as a chromium wash step, and, if required, the article can be coated with an organic or inorganic protective coating. All of the additional steps are well known in the art and may be required by a particular utility for the article which has been degreased. However, some metals will not require additional protective treatment and can be utilized after rinsing and, if required, an additional treatment with a caustic or acid cleaner to remove any residue which remains from degreasing according to this invention.

The following examples illustrate the compositions and methods of the present invention. The examples are for illustrative purposes only and are not intended to limit the invention.

EXAMPLE GROUP 1

A two part concentrate combination was prepared, with the compositions shown in Tables 1 and 2 below. The total parts in each case were 1000, with the balance not shown in the tables being water.

To prepare a first working degreasing composition from these concentrates, 1.0 part by weight of Part 1.1 and 1.0 part by weight of Part 1.2 were mixed with 8.0 parts by weight of water. The mixture was heated to a temperature of 37.5° C. The pH of the solution was 10. Fifty aluminum panels were prepared by soiling the panels with light oil (3-IN-1™), lipstick, axle grease, COSMOLENE™, black SHARPIE™, red MAGIC MARKER™, BAYCO™ 363, CINFLO™, STAYPUT™ 350, CYTAL™ 81, MEROPA™ 46, and HD32™ Oil. The soiled panels were then immersed in the diluted mixture of the two concentrate parts at a temperature of 37.5° C. for 15 minutes. The degreasing composition was agitated during the time that the soiled panels were immersed in the degreasing solution. The panels were removed from the degreasing solution, rinsed with warm tap water and visually inspected. All of the soil was removed from the panels. No etching of the aluminum panels was observed by visual inspection or by the

TABLE 1

COMPOSITION OF CONCENTRATE PART 1.1

| Component: | Parts of Component in Concentrate Part 1.1: |
|---|---|
| 45% Solution of KOH in water | 75 |
| $Na_2B_4O_7 \cdot 5\ H_2O$ (granular) | 35 |
| ACUSOL ™ 102 | 84.0 |
| MONATROPE ™ 1296 | 40 |
| Nonenyl succinic anhydride | 25 |
| TERGITOL ™ TMN-3 | 30 |
| TERGITOL ™ TMN-6 | 10 |
| ANTAROX ™ BL-334 | 15 |
| TRITON ™ DF-20 | 20 |
| MAZON ™ RI-263 | 5 |
| COBRATEC ™ 725 | 1 |
| DOWANOL ™ DB | 80 |

Notes for Table 1

ACUSOL ™ 102 is an organic builder product of Rohm and Haas Corporation, which is reported by its supplier to contain 49–51% of polycarboxylate copolymer, 49–51% of propylene glycol, with the balance if any made up of an ethoxylated $C_{12-15}$ alcohol.

TERGITOL ™ TMN-3 and TMN-6 are commercially available from Union Carbide Corp. and are reported by their supplier to be ethoxylates of 2,6,8-trimethyl-4-nonanol, with an molecular weight of 318 and an HLB of 8.3 for TMN-3 and an average molecular weight of 450 and an HLB value of 11.7 for TMN-6.

ANTAROX ™ BL-344 is commercially available from Rhône-Poulenc (NJ), Surfactant and Specialty Div., and is reported by its supplier to be a chlorine-capped straight chain aliphatic polyether nonionic surfactant.

TRITON ™ DF-20 is commercially available from Union Carbide Corp. and is reported by its supplier to be a modified ethoxylate anionic surfactant.

MAZON ™ RI-263 was obtained commercially from PPG Corp., Specialty Chemicals Business Unit, Gurnee, Illinois and is reported by its supplier to be a corrosion inhibitor with a proprietary chemical structure.

COBRATEC ™ 725 is commercially available from PMC Specialties Group, Cincinnati, Ohio and is reported by its supplier to be a triazole derivative corrosion inhibitor.

DOWANOL ™ DB is commercially available from Dow Chemical Co. and is reported by its supplier to be n-butyl diethylene glycol.

MONATROPE ™ 1296 is commercially available from Mona Industries and is reported by its supplier to be an organic phosphate ester hydrotroping agent.

TABLE 2

COMPOSITION OF CONCENTRATE PART 1.2

| Component: | Parts of Component in Concentrate Part 1.2 |
|---|---|
| 45% Solution of KOH in water | 45 |
| KaSil ™ No. 6 | 50 |
| DOWANOL ™ DB | 80 |
| MAZON ™ RI-263 | 5 |
| COBRATEC ™ 725 | 2.5 |

Notes for Table 2

KaSil ™ No. 6 is commercially available from PQ Corp., Valley Forge, Pennsylvania and is reported by its supplier to be a 38.8% aqueous solution of potassium metasilicate with a stoichiometrically equivalent $K_2O$ concentration of 12.5% and a stoichiometrically equivalent $SiO_2$ concentration of 26.3%. Other components identified by trademark are described in the notes for Table 1.

etch rate test according to Boeing Standard Specification 7348.

A second degreasing composition was prepared by mixing 1.5 parts of Composition 1.1, 0.5 parts of Composition 1.2 and 8.0 parts of water. The soiled aluminum panels were immersed in the solution for 15 minutes at a temperature of 37.5° C. Upon removal of the panels from the degreasing solution the panel appeared to be free of all the soil which had been previously applied.

EXAMPLE GROUP 2

A clear, single package concentrate composition was prepared and denoted as Composition 2. Its constituents are given in Table 3, except that the balance not shown in Table 3, to a total of 1000 parts, was deionized water.

One part by weight of concentrate Composition 2 was mixed with 9.0 parts by weight of water and heated to 37.5 ° C. to form working Composition 2.W1. The pH of the solution was 7.5. Aluminum panels soiled as in Example 1 were immersed in the heated Composition 2.W1 for 15 minutes. The degreasing solution was agitated during the time that the soiled panels were immersed in the degreasing composition. The panels were removed from the degreasing solution, rinsed with warm tap water and visually inspected. All of the soil was removed from the panels. No etching of the panels was observed by visual inspection or by the etch rate test according to Boeing Standard Specification 7348.

TABLE 3

CONSTITUENTS OF CONCENTRATE COMPOSITION 2

| Constituent | Parts by Weight of Constituent in Composition 2 |
|---|---|
| 45% Solution of KOH in Water | 95.0 |
| ACUSOL ™ 102 | 200.0 |
| Citric Acid · 2 $H_2O$ | 20.0 |
| TERGITOL ™ TMN3 | 30.0 |
| TERGITOL ™ TMN6 | 10.0 |
| EXXON ™ Alkali Surfactant (QT) | 10.0 |
| ANTAROX ™ BL 344 | 10.0 |
| N-Octyl Pyrrolidone | 25.0 |
| DOWANOL ™ DB | 60.0 |
| Ethylene Glycol | 40.0 |
| COBRATEC ™ 725 | 5.0 |
| MAZON ™ RI 263 | 10.0 |
| $H_2O$ (Tap) | 475.0 |

Notes for Table 3

EXXON ™ Alkali Surfactant (QT) is commercially available from Tomah Chemical Products, Milton, Wisconsin and is reported by its supplier to be an amphoteric surfactant that is a substituted β-alanine amine derivative with Chemical Abstracts Services Registry # 64972-19-6. The source of the N-octyl pyrrolidone used was a commercial product, SURFADONE ™ LP-100.

A second working degreasing Composition 2.W2 was prepared by mixing 2.0 parts by weight of the concentrate Composition 2 with 8.0 parts of water. The pH of Composition 2.W2 was 8.5. Aluminum panels soiled as in Example 1 were immersed in the heated degreasing Composition 2.W2 for 15 minutes. The degreasing composition was agitated during the time that the soiled panels were immersed in the composition. The panels were removed from the degreasing composition, rinsed with warm tap water and visually inspected. All of the soil was removed from the panels, as evidenced by a water-break free surface after rinsing with deionized water for 30 seconds. No etching of the panels was observed by visual inspection or by the etch rate test according to Boeing Standard Specification 7348.

What is claimed is:

1. An aqueous liquid composition of matter suitable for degreasing metal surfaces, said composition consisting essentially of water and the following dissolved, stably dispersed, or both dissolved and stably dispersed components:

(A) from about 1.8 to about 7% of a component of substantially chlorine free nonionic surfactant molecules conforming to the general formula:

$H_{2a+1-b)}F_bC_A—O—(C_mH_{2m}O)_p—H$ wherein a represents a positive integer that is at least 10, b represents 0 or a positive integer that is not more than (2a+1), m represents a positive integer that is at least 2 and is not more than 4, and p represents a positive integer chosen so that the component has an average hydrophile-lipophile balance ("HLB") value from about 6.0 to 9.5;

(B) from about 0.6 to about 2.5% of a component of substantially chlorine free non-ionic surfactant molecules conforming to the general formula:

$H_{(2a+1-b)}F_bC_a—O—(C_mH_{2m}O)_q—H$ wherein a represents a positive integer that is at least 10, b represents 0 or a positive integer that is not more than (2a+1), m represents a positive integer that is at least 2 and is not more than 4, and p represents a positive integer chosen so that the component has an average HLB value from above 9.5 to 16;

(C) from about 0.6 to about 2.5% of a component of nonionic surfactant that has a polyoxyalkylene chemical structure, except for being chlorine-capped on one or both ends and optionally including total or partial fluorine substitution for hydrogen in the alkylene units;

(D.1) from about 5 to about 40% of a component of organic compounds selected from the group consisting of ethylene, propylene, and butylene glycols;

(D.2) from about 2.0 to about 11% of a component of organic compounds that are liquid at 25° C., and are selected from the group consisting of molecules conforming to the general formula:

$H_{(2c+1-d)}F_dC_c—O—(C_kH_{2k}O)—(C_jH_{2j}O)—H$ wherein; c represents a positive integer: d represents a positive integer that is not more than (2c+1) and is not more than 8; each of j and k, which may be the same or different, represents a positive integer that is at least 2 and is not more than 4; and c, j, and k have a sum that is not more than 10;

(D.3) from about 1.0 to about 6.8% of a component that is liquid at 25° C. and is constituted of molecules selected from the group consisting of organic molecules that include a moiety corresponding to general chemical formula I:

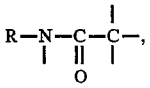

(I)

where R represents a monovalent aliphatic moiety with the chemical formula $C_nH_{(2n+1-y)}F_y$, wherein n is an integer from 6 to 22, and y is an integer from 0 to (2n+1);

(E) a component of alkalinizing agent including from about 0.40 to about 1.4M/kg of a component of alkali metal hydroxide;

(F) from about 0.30 to about 3.5% of a component selected from the group consisting of anionic surfactants and amphoteric surfactants which act effectively as anionic surfactants at the pH of the composition;

(H) from about 0.13 to about 2.5% of a component selected from the group consisting of aromatic triazoles and their salts;

(J.1) from about 2 to about 26% of a component selected from the group consisting of polycarboxylate copolymers; and (J.2) from about 0.7 to about 6% of a component selected from the group consisting of organic acids, and salts of organic acids, that contain at least two—OH moieties which are separated from each other by at least two other atoms in each molecule of the organic acid or salt thereof: and, optionally, (G) a component of hydrotroping agents.

2. A composition according to claim 1, consisting essentially of water and:

from about 2.4 to about 4.5% of component (A);

from about 0.7 to about 1.5% of component (B);

from about 0.7 to about 1.7% of component (C);

from about 9 to about 17% of component D.(1);

from about 4.0 to about 9.0% of component D.(2);

from about 1.8 to about 3.5% of component D.(3);

from about 0.60 to about 1.1M/kg of alkali metal hydroxide;

from about 0.53 to about 2.5% of component (F);

from about 0.30 to about 1.3% of component (H);

from about 5 to about 20% of component (J.1), and from about 0.9 to about 4.5% of component (J.2).

3. A composition according to claim 2, consisting essentially of water and:

from about 2.8 to about 3.2% of component (A) with an average HLB value from about 7.4 to about 9.0;

from about 0.85 to about 1.2% of component (B) with an average HLB value from about 10.8 to about 13.0;

from about 0.85 to about 1.2% of component (C) with an average HLB value from about 10.5 to about 13.7 and no fluorine substitution;

from about 11 to about 15% of component (D.1) selected from the group consisting of ethylene glycol and propylene glycol;

from about 4.7 to about 7.5% of component (D.2) selected from the group consisting of molecules conforming to the general formula:

$H_{(2c+1-d)}F_dC_c—O—(C_kH_{2k}O)—(C_jH_{2j}O)—H,$ wherein c represents a positive integer; d represents 0 or 1; each of j and k, which may be the same or different, represents a positive integer that is 2 or 3; and the sum c+j+k is from 7 to 10;

from about 2.0 to about 2.9% of component (D.3) selected from the group consisting of N-alkyl-2-pyrrolidones where the alkyl group is straight chain and has from 7 to 9 carbon atoms;

from about 0.65 to about 0.90M/kg of potassium hydroxide;

from about 0.85 to about 1.4% of component (F) selected from the group consisting of N-alkylaminocarboxylic acids and their salts;

from about 0.45 to about 0.65% of component (H);

from about 8 to about 12% of component (J.1); and from about 1.50 to about 2.5% of component (J.2).

4. A process of degreasing a soiled metal substrate, comprising steps of:

(I) contacting the substrate with a composition according to claim 1 at a temperature from about 20° to about 80° C. for a time from about 1 to about 120 minutes; and (II) removing the substrate from contact with the composition according to claim 1 and rinsing the surface of the substrate with water.

5. A process according to claim 4, wherein in step (I) the temperature is from about 30° to about 60° C. and the time is from about 4 to about 60 minutes.

6. A process according to claim 5, wherein in step (I) the temperature is from about 34° to about 45° C. and the time is from about 10 to about 20 minutes.

7. A process of degreasing a soiled metal substrate, comprising steps of:

(I) contacting the substrate with a composition according to claim 2 at a temperature from about 20° to about 80° C. for a time from about 1 to about 120 minutes; and (II) removing the substrate from contact with the composition according to claim 4 and rinsing the surface of the substrate with water.

8. A process of degreasing a soiled metal substrate, comprising steps of:

(I) contacting the substrate with a composition according to claim 3 at a temperature from about 20° to about 80° C. for a time from about 1 to about 120 minutes; and (II) removing the substrate from contact with the composition according to claim 5 and rinsing the surface of the substrate with water.

9. An aqueous liquid composition of matter suitable for degreasing metal surfaces, said composition consisting essentially of water and the following dissolved, stably dispersed, or both dissolved and stably dispersed components:

(A) from about 1.8 to about 7% of a component of substantially chlorine free nonionic surfactant molecules conforming to the general formula:

$$H_{(2a+1-b)}F_bC_a—O—(C_mH_{2m}O)_p—H$$

wherein a represents a positive integer that is at least 10, b represents 0 or a positive integer that is not more than (2a+1), m represents a positive integer that is at least 2 and is not more than 4, and p represents a positive integer chosen so that the component has an average hydrophile-lipophile balance ("HLB") value from about 6.0 to 9.5;

(B) from about 0.6 to about 2.5% of a component of substantially chlorine free nonionic surfactant molecules conforming to the general formula:

$$H_{(2a+1-b)}F_bC_a—O—(C_mH_{2m}O)_q—H$$

wherein a represents a positive integer that is at least 10, b represents 0 or a positive integer that is not more than (2a+1), m represents a positive integer that is at least 2 and is not more than 4, and p represents a positive integer chosen so that the component has an average HLB value from above 9.5 to 16;

(C) from about 0.9 to about 3.7% of a component of nonionic surfactant that has a polyoxyalkylene chemical structure, except for being chlorine-capped on one or both ends and optionally including total or partial fluorine substitution for hydrogen in the alkylene units;

(D.1) from about 1.0 to about 8.9% of a component of organic compounds selected from the group consisting of ethylene, propylene, and butylene glycols;

(D.2) from about 2.4 to about 9.0% of a component of organic compounds that are liquid at 25° C. and are selected from the group consisting of molecules conforming to the general formula:

$$H_{(2c+1-d)}F_dC_c—O—(C_kH_{2k}O)—(C_jH_{2j}O)—H$$

wherein c represents a positive integer; d represents a positive integer that is not more than (2c+1) and it not more than 8; each of j and k, which may be the same or different, represents a positive integer that is at least 2 and is not more than 4; and c, j, and k have a sum that is not more than 10;

(E.1) from about 0.42 to about 1.2M/kg of alkali metal hydroxide;

(E.2) from about 0.04 to about 0.45M/kg of alkali metal salts of polyfunctional inorganic acids;

(F) from about 0.54 to about 7.0% of a component selected from the group consisting of anionic surfactants and amphoteric surfactants which act effectively as anionic surfactants at the pH of the composition;

(G.1) from about 1.3 to about 12% of a component selected from the group consisting of organic phosphate esters;

(G.2) from about 0.7 to about 6.8% of a component selected from the group consisting of alkyl- and alkenyl-substituted cyclic acid anhydrides;

(H) from about 0.027 to about 0.5% of a component selected from the group consisting of aromatic triazoles and their salts; and (J) from about 1.0 to about 13% of a component selected from the group consisting of polycarboxylate copolymers.

10. A composition according to claim 9, consisting essentially of water and:

from about 2.2 to about 4.0% of component (A);

from about 0.6 to about 1.5% of component (B);

from about 1.2 to about 2.5% of component (C);

from about 1.0 to about 5.8% of component (D.1);

from about 50 to about 9.0% of component (D.2);

from about 0.47 to about 1.0M/kg of alkali metal hydroxide;

from about 0.08 to about 0.19M/kg of alkali metal salts of polyfunctional inorganic acids;

component (F) in an amount from about 1.0 to about 2.7 %;

from about 2.8 to about 5.2% of component (G)(1);

from about 1.8 to about 3.5% of component (G)(2);

from about 0.07 to about 0.17% of component (H); and from about 3.1 to about 5.8% of component (J).

11. A composition according to claim 10, consisting essentially of water and:

from about 2.8 to about 3.2% of component (A) with an average HLB value from about 7.4 to about 9.0;

from about 0.8 to about 1.2% of component (B) with an average HLB value from about 10.8 to about 13.0;

from about 1.40 to about 1.65% of component (C) with an average HLB value from about 10.5 to about 13.7 and no fluorine substitution;

from about 3.8 to about 4.5% of component (D.1) selected from the group consisting of ethylene glycol and propylene glycol;

from about 7.0 to about 9.0% of component (D.2) selected from the group consisting of molecules conforming to the general formula:

$$H_{(2c+1-d)}F_dC_c—O—(C_kH_{2k}O)—(C_jH_{2j}O)—H$$

wherein c represents a positive integer; d represents 0 or 1; each of j and k, which may be the same or different, represents a positive integer that is 2 or 3; and the sum c+j+k is from about 7 to 10;

from about 0.51 to about 0.80M/kg of potassium hydroxide;

from about 0.09 to about 0.14M/kg of alkali metal tetraborates;

component (F) in an amount from about 1.4 to about 2.2%;

from about 3.50 to about 4.4% of component (G.1);

from about 2.2 to about 2.9% of component (G.2);

from about 0.08 to about 0.13% of component (H); and from about 3.8 to about 4.7% of component (J).

12. A process of degreasing a soiled metal substrate, comprising steps of:

(I) contacting the substrate with a composition according to claim 9 at a temperature from about 20° to about 80° C. for a time from about 1 to about 120 minutes; and (II) removing the substrate from contact with the composition according to claim 7 and rinsing the surface of the substrate with water.

13. A process according to claim 12, where in step (I) the temperature is from about 30° to about 60° C. and the time is from about 4 to about 60 minutes.

14. A process according to claim 13, wherein in step (I) the temperature is from about 34° to about 45° C. and the time is from about 10 to about 20 minutes.

15. A process of degreasing a soiled metal substrate, comprising steps of:

(I) contacting the substrate with a composition according to claim 10 at a temperature from about 20° to about 80° C. for a time from about 1 to about 120 minutes; and (II) removing the substrate from contact with the composition according to claim 6 and rinsing the surface of the substrate with water.

16. An aqueous liquid composition of matter suitable for degreasing metal surfaces, said composition having a pH from about 7.4 to about 11.0 and consisting essentially of water and the following dissolved, stably dispersed, or both dissolved and stably dispersed components:

(A) from about 2.0 to about 60 g/L of a component of nonionic surfactant selected from the group consisting of molecules conforming to the general formula:

$$H_{(2a+1-b)}F_bC_a—O—(C_mH_{2m}O)_p—H$$

wherein a represents a positive integer from 10 to about 20; b is either 0 or 1; m is 2 or 3; and p represents a positive integer chosen so that, in the average for the component, the HLB value is from about 7.0 to about 8.9;

(B) from about 0.70 to about 2.4 g/L of a component of nonionic surfactant selected from the group consisting of molecules conforming to the general formula:

$$H_{(2a+1-b)}F_bC_a—O—(C_mH_{2m}O)_q—H$$

wherein a represents a positive integer from about 12 to about 20; b is 0 or 1; m is 2 or 3; and q represents a positive integer chosen so that, in the average for the component, the HLB value is from about 10.8 to about 12.8;

(C) from about 0.4 to about 4.0 g/L of a component of chlorine-capped polyoxyalkylene nonionic surfactant having an HLB value from about 10.9 to about 13.7;

(D) organic compounds that are liquid at 25° C. and that include at least one of (i) from 2.0 to 20 g/L of molecules selected from the group consisting of ethylene, propylene, and butylene glycols; (ii) from 5.0–9.0 g/L of molecules conforming to the general formula:

$$H_{(2c+1)}C_c—O—(C_kH_{2k}O)—(C_jH_{2j}O)—H \quad ,$$

wherein c represents a positive integer; each of j and k, which may be the same or different, represents a positive integer that is 2 or 3; and the sum c+j+k is from 7 to 10; and (iii) from 20 to 3.2 g/L of N-alkyl-2-pyrrolidones with an alkyl group having from about 7 to about 9 carbon atoms;

(F) from about 0.80 to about 3.7 g/L of a component selected from the group consisting of anionic surfactants and amphoteric surfactants which act effectively as anionic surfactants at the pH of the composition, including at least one of (i) N-alkyl-amino carboxylic acids and their salts and (ii) anionic surfactants including a polyoxyethylene block in their molecular structure;

(G) up to about 70 g/L of a component of hydrotroping agent;

(H) from about 0.40 to about 2.4 g/L of a component of organic corrosion inhibitors; and (J) from about 2.5 to about 16 g/L of a component of sequestering agents, including at least 2.8 g/L of polycarboxylate copolymer.

17. A composition according to claim 16 having a pH from about 8.0 to about 8.7 and consisting essentially of water and:

(A) from about 2.7 to about 4.7 g/L of a component of nonionic surfactant selected from the group consisting of molecules conforming to the general formula:

$$H_{(2a+1)}C_a——(C_2H_4O)_p—H$$

wherein a represents a positive integer from about 12 to about 16 and p represents a positive integer chosen so that, in the average for the component, the HLB value is from about 7.9 to about 8.3;

(B) from about 0.91 to about 1.8 g/L of a component of nonionic surfactant selected from the group consisting of molecules conforming to the general formula:

$$H_{(2a+1)}C_a—O—(C_mH_{2m}O)_q—H$$

wherein a represents a positive integer from about 12 to about 16 and q represents a positive integer chosen so that, in the average for the component, the HLB value is from about 11.4 to about 12.0;

(C) from about 0.80 to about 2.4 g/L of a component of chlorine-capped polyoxyalkylene nonionic surfactant having an HLB value from about 11.9 to about 12.8 and no fluorine substitution;

(D) organic compounds that are liquid at 25° C. and that include at least two of (i) from 4.1 to 15 g/L of ethylene glycol, propylene glycol, or both; (ii) from 5.5 to 8.7 g/L of diethylene glycol monobutyl ether; and (iii) from 2.0 to 3.2 g/L of N-alkyl-2-pyrrolidones with an alkyl group having from about 7 to about 9 carbon atoms; and (J) from about 4.0 to about 11 g/L of a component of sequestering agents, including at least 4.0 g/L of polycarboxylate copolymer.

18. A process of degreasing a soiled metal substrate, comprising steps of:

(I) contacting the substrate with a composition according to claim 16 at a temperature from about 30° to about 60° C. for a time from about 4 to about 60 minutes; and (II) removing the substrate from contact with the composition according to claim 15 and rinsing the surface of the substrate with water.

19. A process according to claim 18, wherein in step (I) the temperature is from about 34° to about 45° C. and the time is from about 10 to about 20 minutes.

20. A process of degreasing a soiled metal substrate, comprising steps of:

(I) contacting the substrate with a composition according to claim 17 at a temperature from about 34° to about 45° C. for a time from about 10 to about 20 minutes; and (II) removing the substrate from contact with the composition according to claim 16 and rinsing the surface of the substrate with water.

* * * * *